United States Patent [19]

Evans

[11] 4,018,146

[45] Apr. 19, 1977

[54] STRAP SNUBBER HORN

[76] Inventor: Elferd L. Evans, 1235 W. I St., Oakdale, Calif. 95361

[22] Filed: Apr. 16, 1976

[21] Appl. No.: 677,688

[52] U.S. Cl. ..... 100/26; 100/2; 100/29; 53/198 R

[51] Int. Cl.[2] ..... B65B 13/04

[58] Field of Search ..... 100/2, 3, 7, 8, 25, 100/26, 32, 29, 30, 31; 53/198 R, 128; 254/79, 68; 140/93.2

[56] References Cited

UNITED STATES PATENTS

| | | | |
|---|---|---|---|
| 2,920,553 | 1/1960 | Van Marle | 100/26 X |
| 3,153,529 | 10/1964 | Owens | 254/79 |
| 3,179,037 | 4/1965 | Cranston | 100/26 X |
| 3,213,781 | 10/1965 | Collins | 100/26 |
| 3,378,987 | 4/1968 | Lems | 53/128 X |
| 3,585,780 | 6/1971 | Elmore | 53/128 X |
| 3,665,845 | 5/1972 | Lyon | 53/198 R |
| 3,735,555 | 5/1973 | Pasic | 53/198 R |
| 3,929,062 | 12/1975 | Thompson | 100/3 |

*Primary Examiner*—Billy J. Wilhite
*Attorney, Agent, or Firm*—Phillips, Moore, Weissenberger, Lempio & Majestic

[57] ABSTRACT

A strapping machine for palletized loads wherein probes are positioned and held against movement at the upper edges of the load. The strap which secures the load to the pallet is snubbed around the probes as the strap is tautened. After the strap has been tautened and clamped, the probes are removed so that the tautened strap engages the upper edges of the load.

11 Claims, 10 Drawing Figures

STRAP SNUBBER HORN

BACKGROUND OF THE INVENTION

This invention relates to strapping machines which fasten a steel or plastic strap around a load, and particularly to machines which operate upon palletized loads.

A great many manufacturing process result in the manufactured goods being put into cardboard cartons, the cartons being then stacked on pallets. To protect the goods during shipping or storage, the cartons are secured to the pallet by steel or plastic straps. Typically, the palletized load is strapped by a machine which passes a strap under the pallet, up the sides and across the top of the load. The strap ends are pulled taut, generally at the top of the load, and the ends of the strap are clamped together.

The strap must be sufficiently tautened so that shifting of the load on the pallet will not occur during shipment or handling by fork lift trucks. At the same time, the tension on the strap must not be so high as to cause a crushing of the cartons engaged by the strap, particularly the cartons on the upper tier around which the strap passes. Typically, a strapping machine will be set to tauten the strap at a relatively high tension but safely below the crush points of the cartons.

However, even though a tension is used which is below the crush point, oftentimes the strapping operation will result in a crushing of the upper edge cartons. As the strap is tautened it will be pulled across the upper edge of the load with increasing force. The friction resulting from this snubbing movement will increase the stress on the carton edge considerably beyond that which would be imposed by the strap tension if there were no movement of the storage across the edge.

In order to protect against such crushing, boards are often placed along the upper edge of the load between the strap and cartons to absorb the snubbing stress and prevent it from being applied to the carton edges. The boards are left in place until such time as the straps are removed and the cartons are unloaded. However, the labor and material involved results in a considerable increase in cost. Furthermore, the use of such boards increases the size of the load and decreases the number of pallets which may be stored or shipped in a given floor area.

It is a primary object of the present invention to provide an improved strapping machine wherein a dynamic snubbing stress will not be imposed on the load as it is being strapped so that the load will only be subjected to the static force of the finally tautened strap.

SUMMARY OF THE INVENTION

The primary object of the present invention is achieved by providing snubber horn mechanisms which have probes around which the strap passes during the strapping operation. These probes are automatically positioned at the top edge of the palletized load and held against movement relative to the load. The strap is then snubbed around the probes as the strap is tautened so that the snubbing stress is not imposed on the load. After the strap has been tautened and clamped the probes are removed so that the clamped strap engages the load.

Other objects and advantages will be set forth in the course of the following detailed description.

BRIEF DESCRIPTION OF THE DRAWINGS

Referring now to the drawings, wherein like parts are designated by like reference numerals throughout the same.

DESCRIPTION OF THE PREFERRED EMBODIMENTS

Figure 1:
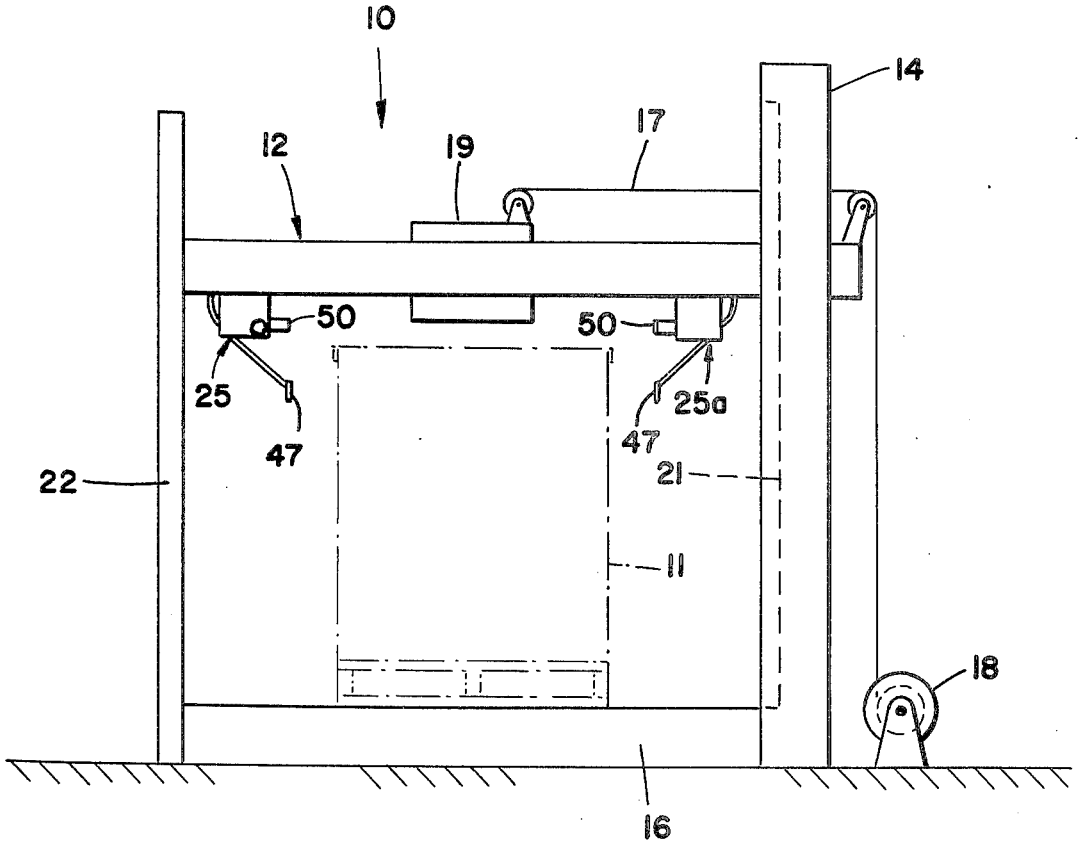
FIG. 1 is an elevational view, illustrating a conventional steel strapping machine, equipped with the snubber horn mechanisms of the present invention.
Figure 2:
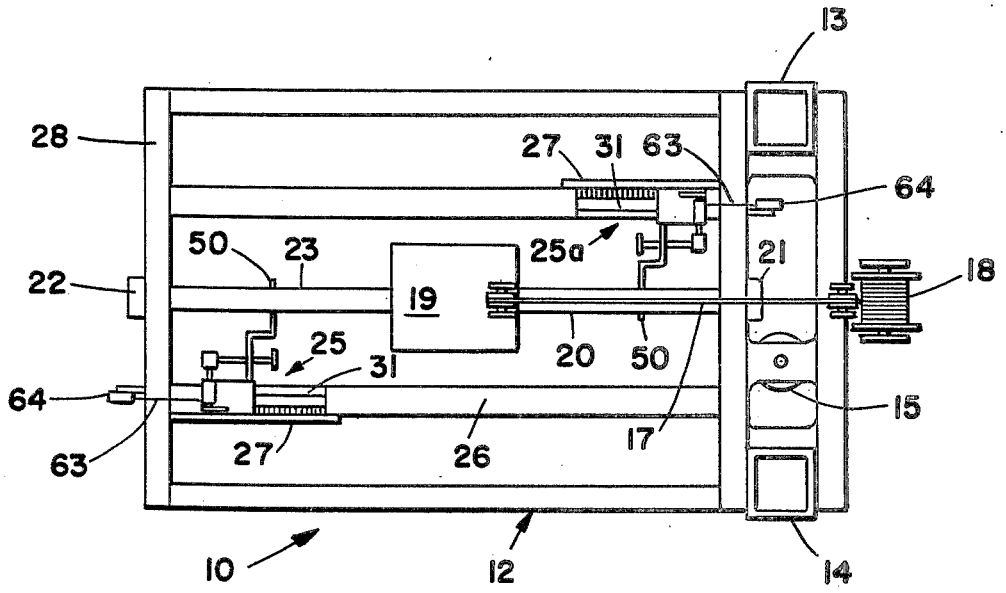
FIG. 2 is a plan view of the machine of FIG. 1.

Referring now to the drawings, and in particular to FIGS. 1 and 2, the reference numeral 10 designates a typical strapping machine utilized for banding a palletized load 11 with a steel strap therearound. Such machines comprise a platform 12 movable up and down on masts 13 and 14 by a hydraulic piston 15. In operation, a palletized load 11 will be moved on conveyor 16 to the strapping machine and a strap 17, from supply reel 18, will be passed from the strapping head 19 through platform guide 20, vertical guide 21, under the pallet, up through vertical guide 22 and back through platform guide 23 to the strapping head to encircle the load. The strapping head is lowered by the platform onto the top of the load and functions to pull the strap taut around the load and clamp the ends of the strap together. Machines as thus described are commercially available, as, for example, from Signode Steel Strapping Co., of Chicago, Illinois.

A machine as thus described is modified in accordance with the present invention by the addition of the snubber horn mechanisms 25 and **25*a*.** These mechanisms are identical and a description of one will apply to the other.

The platform 12 of the machine 10 is modified by removing a portion of beam 26 and replacing it with an elongated plate 27 extending between and welded to the end of beam 26 and end member 28. Plate 27 has a plurality of spaced apart slots 29 (FIG. 3) through which bolts 30 may pass to secure track member 31 to the plate. The slots 29 are vertically elongated so that the track 31 may be vertically adjusted relative to platform 12.

Track member 31 is H-shaped in cross section, having longitudinally extending grooves 32 and 33 along the top and bottom thereof, and having ratchet teeth 34 along the length of one of the upstanding legs 35 thereof.

Carriage 36 is mounted on track member 31, carriage 36 having rollers 37 and 38 thereon received in grooves 32 and 33 respectively and rollers 39 and 40 thereon in rolling engagement will be the top and bottom of leg 41 of the track member. The various rollers permit the carriage to roll easily along track member 31 while restraining it from any tilting relative thereto.

Figure 3:
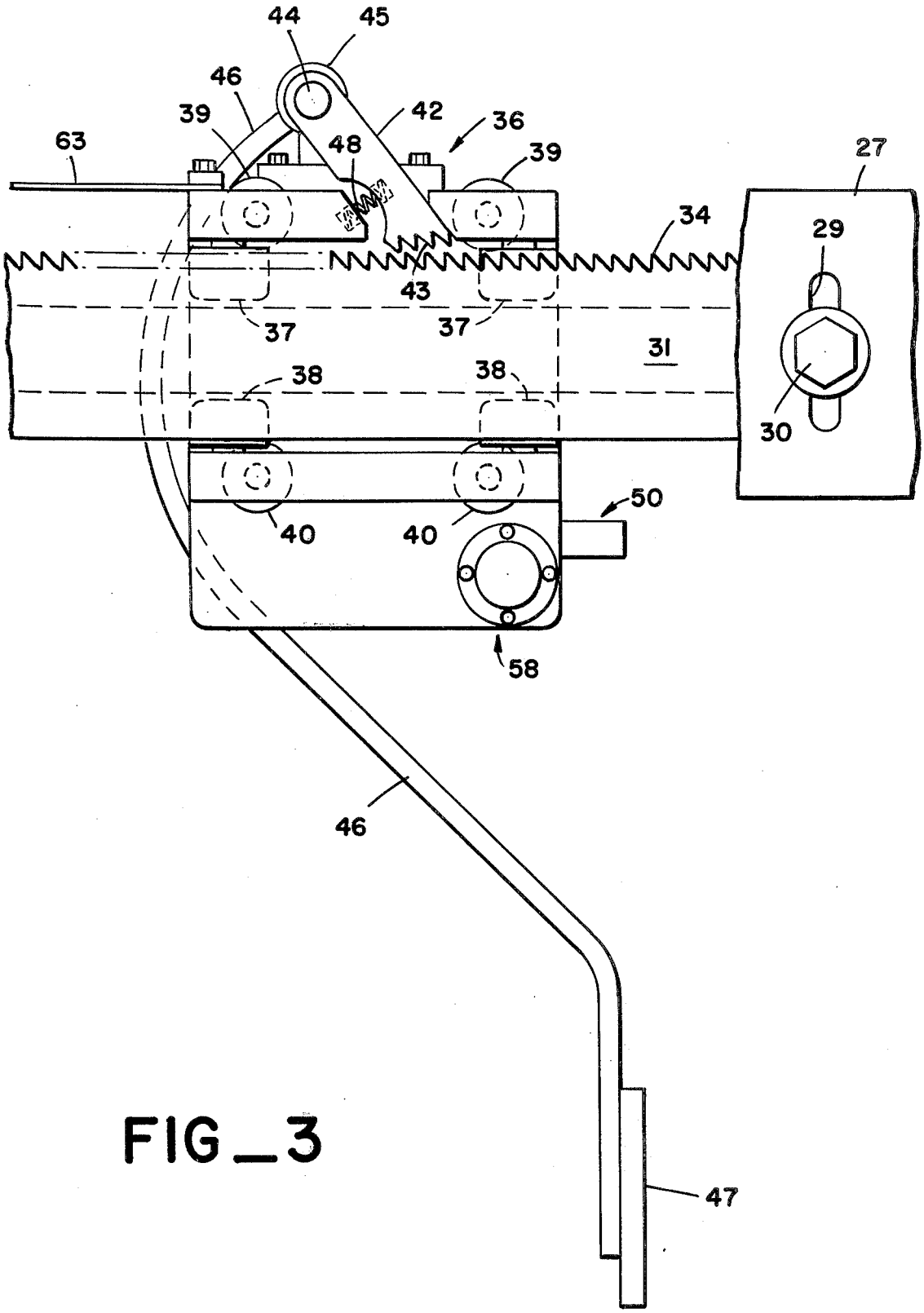
FIG. 3 is a side elevational view of one of the snubber horn mechanisms of FIG. 1.

Locking lever 42, having ratchet teeth 43 on the lower end thereof, is fixed to shaft 44 which extends across the top of carriage 36 and is journaled in bearing 45. Arm 46 is fixed to the other end of shaft 44, arm 46 extending downwardly and forwardly of the carriage and terminating in pad 47. As seen in FIG. 3, if pad 47 is held stationary, movement of carriage 36 to the right will pivot shaft 44 and cause locking lever 42 to swing downwardly so that the locking lever teeth 43 engage the ratchet teeth 34 of track member 31. The ratchet teeth are inclined in such manner that when engaged, carriage 31 is positively held against movement to the right on track member 31. Locking lever 42 is normally biased by spring 48 so that the ratchet teeth are out of engagement.

Figure 4:
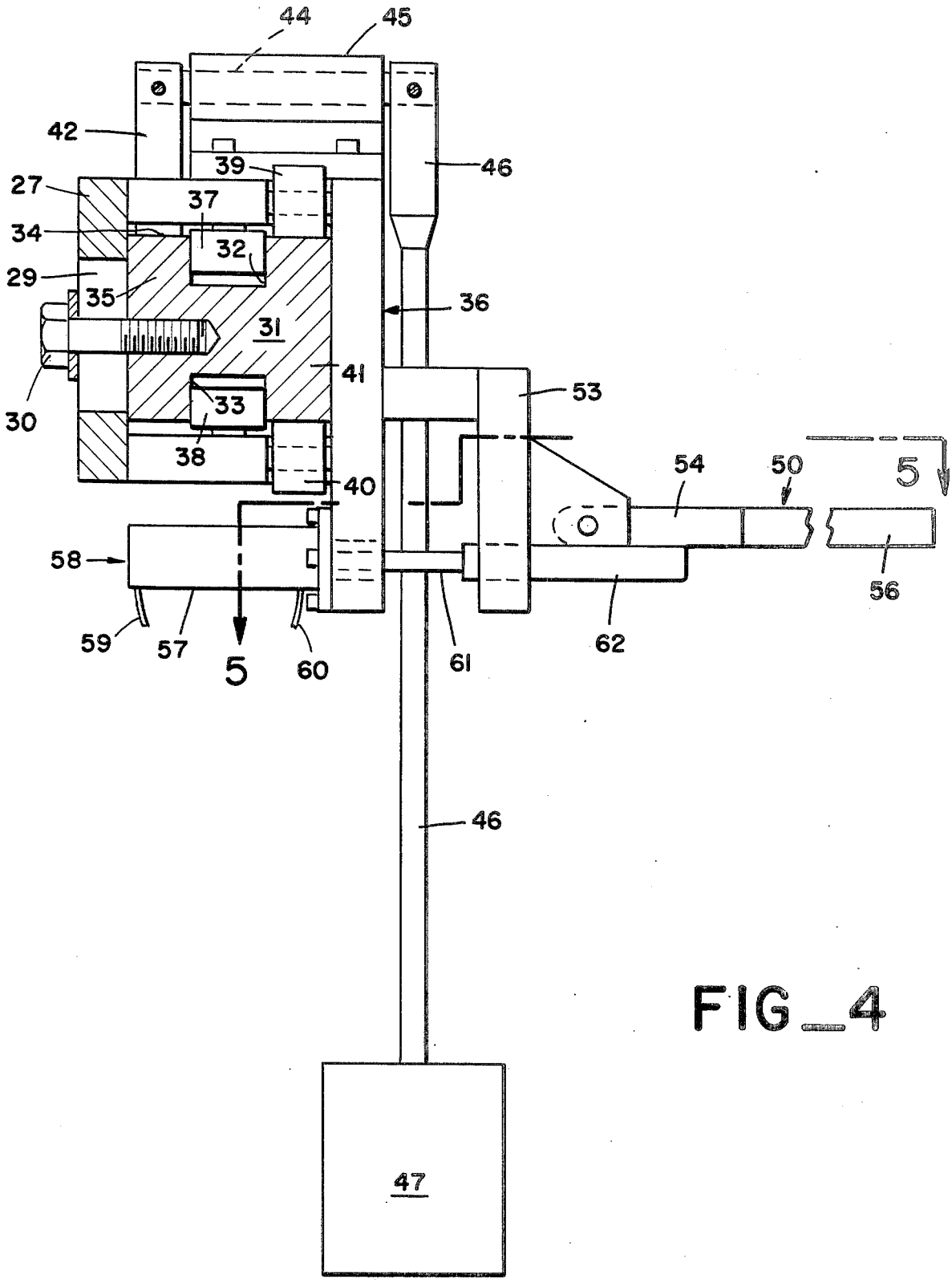
FIG. 4 is a front elevational view of the snubber horn mechanism of FIG. 4.
Figure 5:
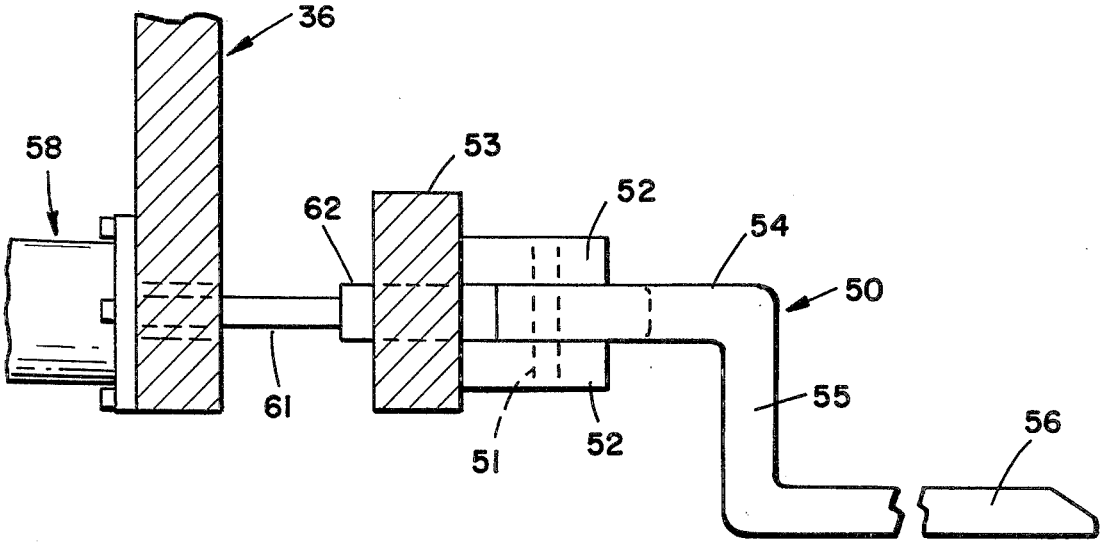
FIG. 5 is a sectional view, taken on the line 5—5 of FIG. 4.
Figure 6:
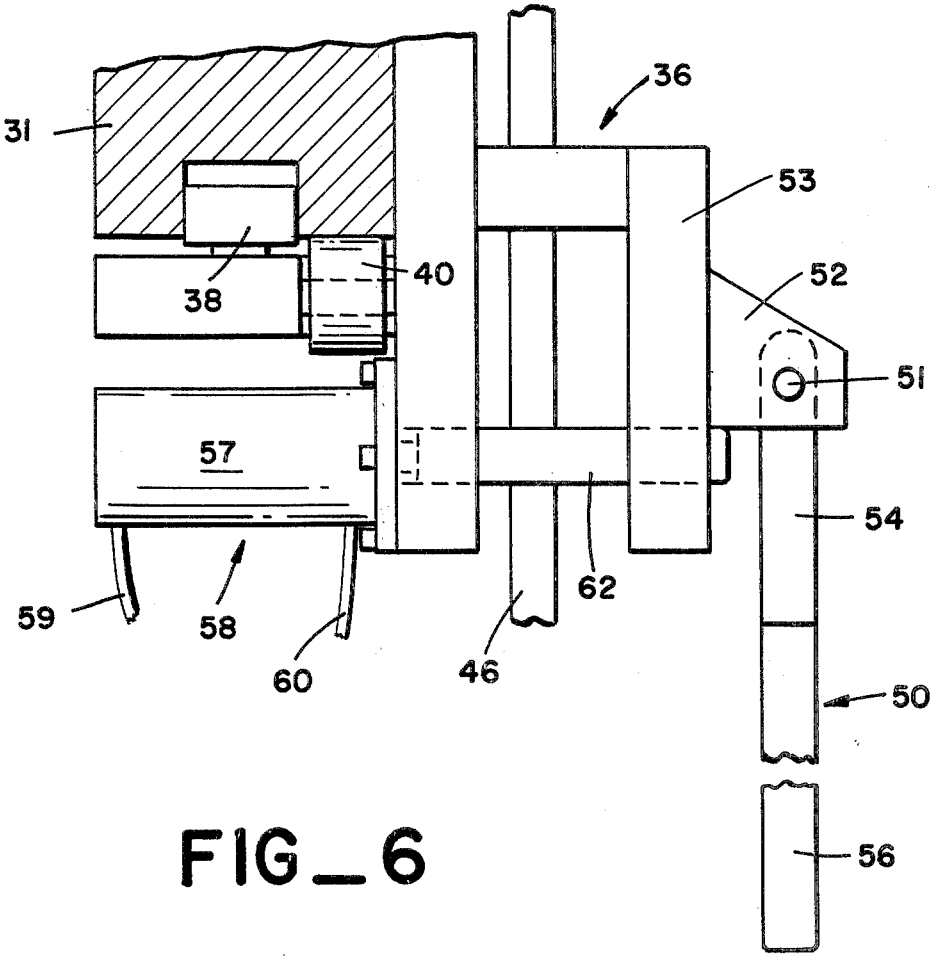
FIG. 6 is a detail view of a portion of FIG. 4, illustrating the probe in releasing position.

Carriage 36 carries thereon a rigid probe 50 which is mounted by shaft 51 to brackets 52 on carriage plate 53 for pivotal movement about a horizontal axis and between the horizontal and vertical positions shown in FIGS. 4 and 6. As seen in FIG. 5, probe 50 has a first portion 54 extending transversely away from the carriage and parallel to probe portion 54.

Carriage 36 also has mounted thereon cylinder 57 of double-acting pressure-actuated ram 59, the cylinders having head- and rod-end hoses 59 and 60 connected through a suitable valve control to a pressure source (not shown). The ram piston rod 61 is connected to plunger 62 which passes through carriage plate 53 to underlie probe portion 54 and support the probe in horizontal position when piston rod 61 is extended (FIG. 4). Retraction of piston rod 61 (FIG. 6) pulls plunger 62 out from under probe portion 54 so that the probe 50 is free to pivot downwardly.

Carriage 36 is biased towards the end of platform 12 by means of band 63 which extends from carriage 36 to spring reel 64 mounted on the end of platform 12.

The operation of the machine is illustrated in FIGS. 7–10. Initially, the snubber horn mechanisms 25 and **25*a* are in retracted positions at the ends of platform 12, and the rams 57 have been actuated to extend plungers 62 to move probes 50 to and hold them horizontally so that the probes will intercept the strap 17. A palletized load 11 is positioned in the machine and the steel strap 17 is passed around the load through strap guides 20, 21, 22 and 23. Platform 12 is lowered so that the strapping head 19** is on the top of the load.

Figure 7:
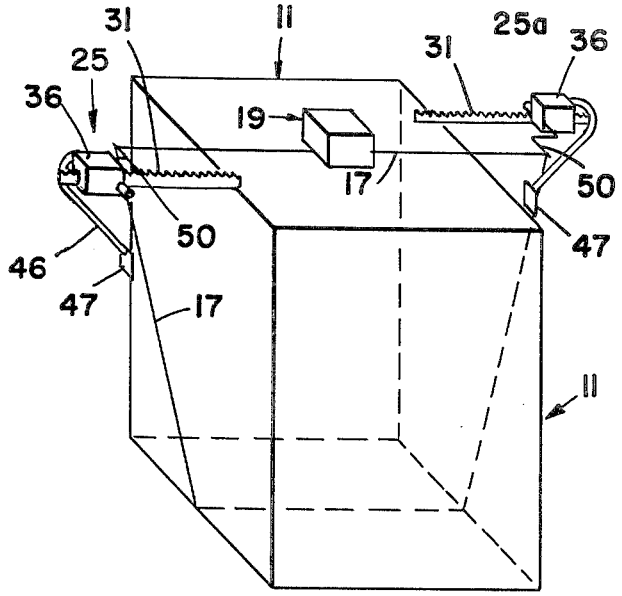
FIGS. 7–10 are schematic illustrations of the operations utilizing the present invention.

As the strap is begun to be tautened by the strapping head, the strap will be pulled from the guides and onto the probes 50 which extend into the path of the strap (FIG. 7).

Figure 8:
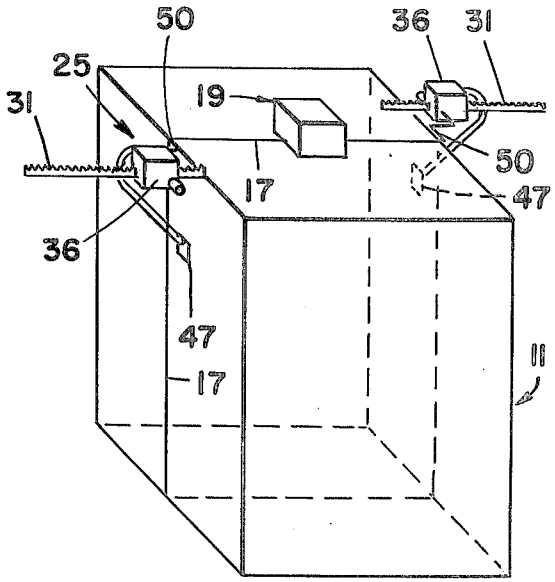

Continued tautening of the strap will then pull probes 50 towards the load and thereby cause carriages 36 to move along tracks 31. When pads 47 engage the sides of load 11 they will be stopped thereby so that further movement of carriages 36 will cause the ratchet teeth of the locking levers 42 and tracks 31 to interengage, locking the carriages against further movement (FIG. 8).

Since the strapping head is fixed to the platform 12, and since the probes move in a plane parallel to the platform and at a fixed distance therebelow, the probes will always be at a constant height relative to the strapping head, regardless of the height of the load. Tracks 31 are initially adjusted by both 30 and slots 29 so that the probes will be positioned at the upper edges of the load when the strapping head is lowered onto the top of the load.

The carriages 36 are independently movable towards the load and are independently actuated to locked position by the engagement of pads 47 with the sides of the load. Accordingly, both probes 50 will be stopped at a fixed distance relative to the sides of the load regardless of the width of the load or whether the load is off-center in the machine. The pad arms 46 are initially adjusted and fixed to shafts 44 so that the probes 50 will just engage the upper edges of the load when the carriages are locked against further inward movement.

Strapping head 19 will continue to tauten strap 17 around the load and probes 50. Since the probes are now held by the carriages against further inward movement, the probes will bear the force of the tightening strap as it is snubbed around the probes and the side edges of the load are protected against crushing during this time.

Figure 9:
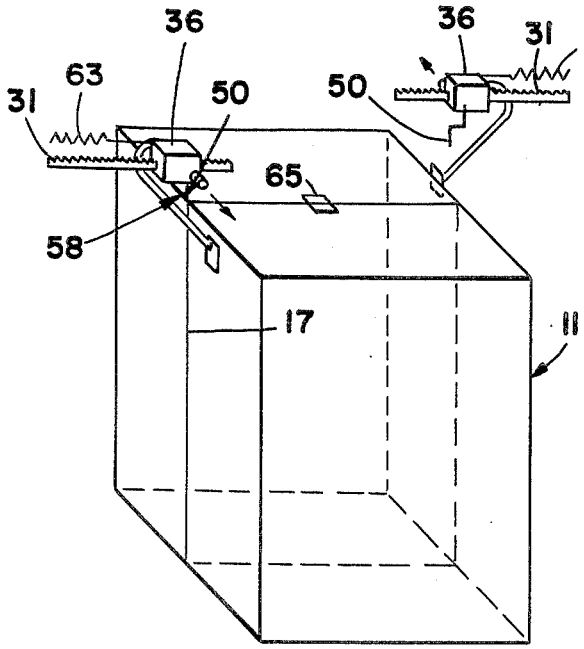
Figure 10:
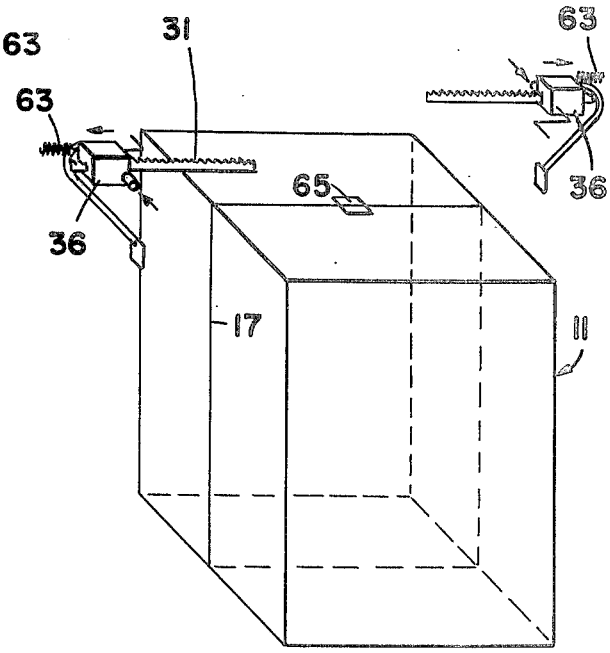

When the strap 17 is properly tautened, strapping head 19 will affix a clamp 65 to the strap ends (FIG. 9). Rams 58 are now actuated to retract plungers 62 and platform 12 is raised. Since the probes are now free to pivot downwardly, they will do so as the platform is raised, and the probes will be pulled out from under the strap, allowing the tautened and clamped strap to now engage the upper edges of the load.

As the pads 47 are moved up above the load, springs 48 will disengage locking levers 42 from tracks 31 so that spring reels 64 will pull the carriages back to their outward positions. Rams 58 are actuated to extend plungers 62 to raise probes 50 back to their horizontal position for the next strapping operation. The palletized load may be shifted in the strapping machine to place another strap around the load in the same direction or the load may be turned 90° in the machine so that a strap may be applied at right angles to the preceding strap.

I claim:

1. In a strapping machine for affixing a tautened strap under, up the sides of and across the top of a load, said machine having a vertically movable platform and a strapping head carried by said platform, said strapping head being operable to tauten the straps around the load and clamp the ends of the tautened strap together, the improvement comprising:

a. a pair of probes mounted on said platform on opposite sides of said strapping head and positioned to intercept said strap during initial strapping operation;

b. means for positioning said probes adjacent opposed upper edges of said load;

c. means for holding said probes against movement relative to said platform when said probes are positioned adjacent said opposed upper edges of said load; and d. means for removing said probes from between said strap and said load after tautening and clamping of said strap.

2. In a strapping machine improvement as set forth in claim 1, wherein the means (b) for positioning each of said probes comprisies:

a. a track fixedly mounted on said platform in parallelism with said strap; and b. a carriage movable along said track, said carriage having said probe mounted thereon for movement therewith, said probe extending laterally from said carriage.

3. In a strapping machine improvement as set forth in claim 2, and further including spring means extending between said platform and said carriage for biasing said carriage for movement along said track in a direction away from said strapping head.

4. In a strapping machine improvement as set forth in claim 1, wherein the means (b) for positioning each of said probes comprises:

a track fixedly mounted on said platform in parallelism with said strap; and a carriage movable along said track, said carriage having said probe mounted thereon for movement therewith, said probe extending laterally from said carriage; and wherein said means (c) for holding each of said probes against movement relative to said platform comprises a pad carried by said carriage and positioned thereon to engage a side of said load, and means responsive to engagement of said pad with a side of said load for locking said carriage to said track.

5. In a strapping machine improvement as set forth in claim 4, wherein said means responsive to engagement of said pad with a side of said load for locking said carriage to said track includes:

ratchet teeth formed along said track;

a lock member carried by said carriage and mounted thereon for movement into and out of locking engagement with said ratchet teeth;

spring means biasing said lock member out of engagement with said ratchet teeth; and means responsive to relative motion of said carriage and said pad for moving said lock member against the bias of said spring means into engagement with said ratchet teeth.

6. In a strapping machine improvement as set forth in claim 1 wherein the means (b) for positioning each of said probes comprises:

a track fixedly mounted on said platform in parallelism with said strap; and a carriage movable along said track, said carriage having said probe mounted thereon for movement therewith, said probe extending laterally from said carriage, and wherein said means (d) for removing said probe includes means mounting said probe on said carriage for pivotal movement of said probe about a horizontal axis, and means releasably supporting said probe in a horizontal position.

7. In a strapping machine improvement as set forth in claim 6 wherein said means releasably supporting said probe in a horizontal position comprises a plunger mounted on said carriage for movement between a first position wherein said plunger underlies a portion of said probe and supports said probe horizontally and a second position wherein said plunger is withdrawn from under said probe and a pressure-actuated ram mounted on said carriage for moving said plunger between its first and second positions.

8. In a strapping machine improvement as set forth in claim 7, and further including spring means extending between said platform and said carriage for biasing said carriage for movement along said track in a direction away from said strapping head.

9. In a strapping machine improvement as set forth in claim 1, wherein the means (b) for positioning each of said probes comprises:

a track fixedly mounted on said platform in parallelism with said strap;

a carriage movable along said track, said carriage having said probe mounted thereon for movement therewith, said probe extending laterally from said carriage, wherein said means (c) for holding load of said probes against movement relative to said platform comprises a pad carried by said carriage and positioned thereon to engage a side of said load, means responsive to engagement of said pad with a side of said load for locking said carriage to said track, and wherein said means (d) for removing said probe includes means mounting said probe on said carriage for pivotal movement of said probe about a horizontal axis, and means releasably supporting said probe in a horizontal position.

10. In a strapping machine improvement as set forth in claim 9 wherein said means releasably supporting said probe in a horizontal position comprises a plunger mounted on said carriage for movement between a first position wherein said plunger underlies a portion of said probe and supports said probe horizontally and a second position wherein said plunger is withdrawn from under said probe, and a pressure-actuated ram mounted on said carriage for moving said plunger between its first and second positions.

11. In a strapping machine improvement as set forth in claim 9, and further including spring means extending between said platform and said carriage for biasing said carriage for movement along said track in a direction away from said strapping head.

* * * * *